US006013898A

United States Patent [19]

Mizuno et al.

[11] Patent Number: 6,013,898

[45] Date of Patent: Jan. 11, 2000

[54] CERAMIC HEATER FOR A GLOW PLUG HAVING TUNGSTEN ELECTRODE WIRES WITH METAL COATING

[75] Inventors: Takanori Mizuno; Hiroyuki Kimata, both of Nagoya, Japan

[73] Assignee: NGK Spark Plug Co., Ltd., Nagoya, Japan

[21] Appl. No.: 08/972,708

[22] Filed: Nov. 18, 1997

[30] Foreign Application Priority Data

Nov. 19, 1996 [JP] Japan ..... 8-308146
Oct. 31, 1997 [JP] Japan ..... 9-300372

[51] Int. Cl.[7] ..... F23Q 7/00

[52] U.S. Cl. ..... 219/270; 219/544; 219/541; 123/145 A

[58] Field of Search ..... 219/270, 553, 219/552, 541, 544; 123/145 A; 361/264–266; 338/322, 276; 29/621, 611

[56] References Cited

U.S. PATENT DOCUMENTS

| | | | |
|---|---|---|---|
| 4,650,963 | 3/1987 | Yokoi | 219/270 |
| 5,218,183 | 6/1993 | Kimata | 219/270 |
| 5,362,944 | 11/1994 | Hatanaka et al. | 219/270 |
| 5,852,280 | 12/1998 | Mizuno | 219/270 |
| 5,883,360 | 3/1999 | Tatematsu et al. | 219/270 |

FOREIGN PATENT DOCUMENTS

| | | | |
|---|---|---|---|
| 44 33 505 | 3/1995 | Germany . | |
| 53-769 | 1/1978 | Japan | 219/270 |
| 57-74646 | 5/1982 | Japan . | |
| 60-216 | 1/1985 | Japan | 219/270 |
| 60-217 | 1/1985 | Japan | 219/270 |
| 61-175415 | 8/1986 | Japan | 219/270 |
| 61-179084 | 8/1986 | Japan . | |
| 62-000732 | 6/1987 | Japan . | |
| 64-38991 | 2/1989 | Japan | 219/270 |
| 1-137585 | 5/1989 | Japan | 219/270 |
| 2-117013 | 5/1990 | Japan . | |
| 3-11578 | 3/1991 | Japan . | |
| 03-135456 | 10/1991 | Japan . | |
| 6-78816 | 10/1994 | Japan . | |

*Primary Examiner*—John A. Jeffery
*Attorney, Agent, or Firm*—Morgan, Lewis & Bockius LLP

[57] ABSTRACT

A heater main body (300) obtained by connecting one-side ends (331, 341) of lead-out tungsten wires (33, 34) having a metal deposit (301), e.g., silver, to the ends (321, 322) of a U-shaped heating resistor (32) is embedded in a ceramic powder. The powder containing the heater main body (300) embedded therein is press-molded into a given shape and then sintered by hot pressing to thereby obtain a ceramic heating element (3) in which the other ends (332, 342) of the lead-out wires are exposed on the surface of the resultant sintered body.

11 Claims, 6 Drawing Sheets

CERAMIC HEATER FOR A GLOW PLUG HAVING TUNGSTEN ELECTRODE WIRES WITH METAL COATING

BACKGROUND OF THE INVENTION

1. Field of the Invention

The present invention relates to a ceramic heater obtained by hot-pressing a ceramic powder containing a heater main body embedded therein to sinter the powder, and a producing method thereof.

2. Description of the Related Art

Ceramic heaters have been known which are obtained by fixing one-side ends of two lead-out tungsten wires respectively to both ends of a U-shaped metallic heating material (made of a tungsten alloy), embedding the resultant heater main body in a ceramic powder comprising $Si_3N_4$, Sialon, or AlN as the main component, and hot-pressing the powder containing the heater main body to sinter the powder.

These ceramic heaters are used in ceramic glow plugs to be fitted to diesel engines. In producing such a ceramic glow plug, a cylindrical main metallic shell is used which has at the front end thereof a holding part extending inward and in a rear part thereof a screw thread for fitting to an engine. A ceramic heater of the above-described kind is fitted into the holding part of the main metallic shell through a metallic sheath.

However, in the prior art process for producing a ceramic heater (during hot-pressing for sintering), carbon of a carbon mold and/or carbon contained in an organic binder comes into the materials being hot-pressed to thereby form a layer of a carbon/tungsten reaction product on the surfaces of the lead-out tungsten wires. As a result, for example, the heater main body (composed of lead-out wires and a metallic heating material) suffers an durability endurance reduction and a resistance increase, and the ceramic develops cracks.

SUMMARY OF THE INVENTION

It is an object of the present invention to provide a ceramic heater which during use is free from a trouble such as an endurance reduction or a resistance increase in the heater main body or cracking in the ceramic.

In the first aspect of the present invention, a ceramic heater produced by a process comprises the steps of: coating a pair of lead-out wires with a metal; connecting one-side ends of the pair of lead-out wires comprising tungsten to both ends of a U-shaped heating resistor to obtain a heater main body; embedding the heater main body in a ceramic powder comprising at least one of $Si_3N_4$, Sialon, and AlN; and hot-pressing the powder containing the heater main body embedded therein to sinter the powder to thereby obtain a sinter in which the other ends of the lead-out wires are exposed on a surface of the resultant sinter.

In the second aspect of the present invention, in the ceramic heater according to the second aspect of the present invention, the metal coating comprises a metal selected from silver, gold, platinum, titanium, tantalum, nickel, etc.

In the third aspect of the present invention, in the ceramic heater according to the first or second aspect of the present invention, the heating resistor comprises tungsten element and is either a metallic heating material made of tungsten, a W—Re alloy, etc., or a nonmetallic heating material made from a mixture of a WC powder and a ceramic powder.

In the fourth aspect of the present invention, in the ceramic heater according to the first to third aspect of the present invention, the metal coating on the wire surfaces is formed by electroplating, chemical plating, hot dipping, thermal spraying, vapor deposition, diffusion coating, or application of a cladding material.

In the fifth aspect of the present invention, in the ceramic heater according to the first to fourth aspect of the present invention, wherein the metal coating has a thickness of from 1 to 10 $\mu$m, preferably 3 to 8 $\mu$m.

In the sixth aspect of the present invention, in the ceramic heater according to the first to fifth aspect of the present invention, which is for use in a glow plug to be fitted to a diesel engine.

In the seventh aspect of the present invention, a producing method of a ceramic heater comprises the steps of: connecting one-side ends of a pair of lead-out tungsten wires comprising tungsten, a surface of the lead-out tungsten being coated with a metal selected from Ag, Au, Pt, Ti and Ta, to both ends of a U-shaped heating resistor to obtain a heater main body; embedding the heater main body in a ceramic powder comprising one of $Si_3N_4$, Sialon, or AlN; hot-pressing the powder containing the heater main body embedded therein; sintering the powder to thereby obtain a sintered body; and exposing the other ends of the lead-out wires on a surface of the sintered body.

In the eighth aspect of the present invention, in the producing method according to the seventh aspect of the present invention, wherein the metal coating on the wire surfaces is formed by electroplating, chemical plating, hot dipping, thermal spraying, vapor deposition, diffusion coating, application of a cladding material, etc.

In the ninth aspect of the present invention, in the producing method according to the seventh and eighth aspect of the present invention, the metal coating has a thickness of from 1 to 10 $\mu$m, preferably 3 to 8 $\mu$m.

According to the first, second and seventh aspects of the present invention, a pair of lead-out tungsten wires is formed from tungsten or a tungsten alloy. The surfaces of the lead-out wires are coated with a metal.

One-side ends of the lead-out wires are connected respectively to both ends of a U-shaped heating resistor to produce a heater main body. In order to connect the lead-out wires to the heater main body, for example, one-side ends of the lead-out wires are inserted into a mold, and a granular material for forming a heating resistor is injected into the mold and shaped.

The heater main body is embedded in a powder of a ceramic, e.g., $Si_3N_4$, Sialon, or AlN, and the powder containing the heater main body embedded therein is press-molded into a given shape.

The pressed molded body thus obtained is sintered by hot pressing.

The resultant sintered body is subjected to grinding or the like to expose the other ends of the lead-out wires on the surface of the resultant sintered body.

Since the surfaces of the lead-out tungsten wires have a metal coating, during the sintering by hot pressing, carbon in the carbon mold, remaining carbon component contained in an organic binder, and free carbon generated if the raw material of the ceramic heater contains WC are restrained to come into the lead-out wire. Accordingly, it is possible to reduce the amount of a reaction layer of W (tungsten) formed on the surface of the wire.

As a result, in actual use, the ceramic heater can be prevent to lower the durability endurance of the heater, to increase a resistance, to generate a crack in the ceramic, and the like.

As a metal material of the metal coating, Ag, Au, Pt, Ti or Ta is particularly effective. Incidentally, a reaction layer contains large amount C (carbon) and V (vanadium). It may be considered that one of them is a main cause to form the reaction layer.

According to the third aspect of the present invention, the heating resistor used comprises tungsten element, and is either a metallic heating material made of tungsten, a W—Re alloy, etc., or a nonmetallic heating material made from a mixture of a WC powder and a powder of a ceramic (e.g., $Si_3N_4$, Sialon, or AlN).

Accordingly, the ceramic heater combines excellent exothermic properties (heats up in a short time) and excellent durability (withstands repeated use).

According to fourth and eighth aspects of the present invention, methods for coating the wire surfaces with a metal are not particularly limited. The metal coating may be formed, for example, by electroplating, chemical plating, hot dipping, thermal spraying, diffusion coating, or application of a cladding material.

This metal coating is effective to restrain carbon from the carbon mold or remaining carbon component in the organic binder to come into the lead-out wires during hot pressing for sintering. As a result, the amount of the layer formed on the wire surfaces by the reaction of tungsten is reduced.

According to fifth and ninth aspects of the present invention, if the thickness of the metal coating is smaller than 1 $\mu$m, the coating can not restrain carbon from coming into the lead-out wires during hot pressing for sintering. Hence, this metal coating is less effective to prevent the formation of the undesirable tungsten compound layer.

A metal coating thickness of 10 $\mu$m is sufficient to maximize the effect to prevent the formation of the undesirable tungsten compound layer. Hence, even though a metal coating having a thickness exceeding 10 $\mu$m is formed, this leads only to a cost increase.

As described above, the reaction layer contains large amount of V (vanadium). This is considered as a main factor to generate the reaction layer. Accordingly, it has a large effect particularly in the case of the ceramic powder containing V.

According to the sixth aspect of the present invention, glow plugs employing this ceramic heater combine excellent exothermic properties (heat up in a short time) and excellent durability endurance (withstand repeated use).

Furthermore, the glow plugs are extremely less apt to suffer a trouble during use, such as wire break or a resistance increase in the heater main body or cracking in the ceramic.

DETAILED DESCRIPTION OF THE INVENTION

Figure 1:
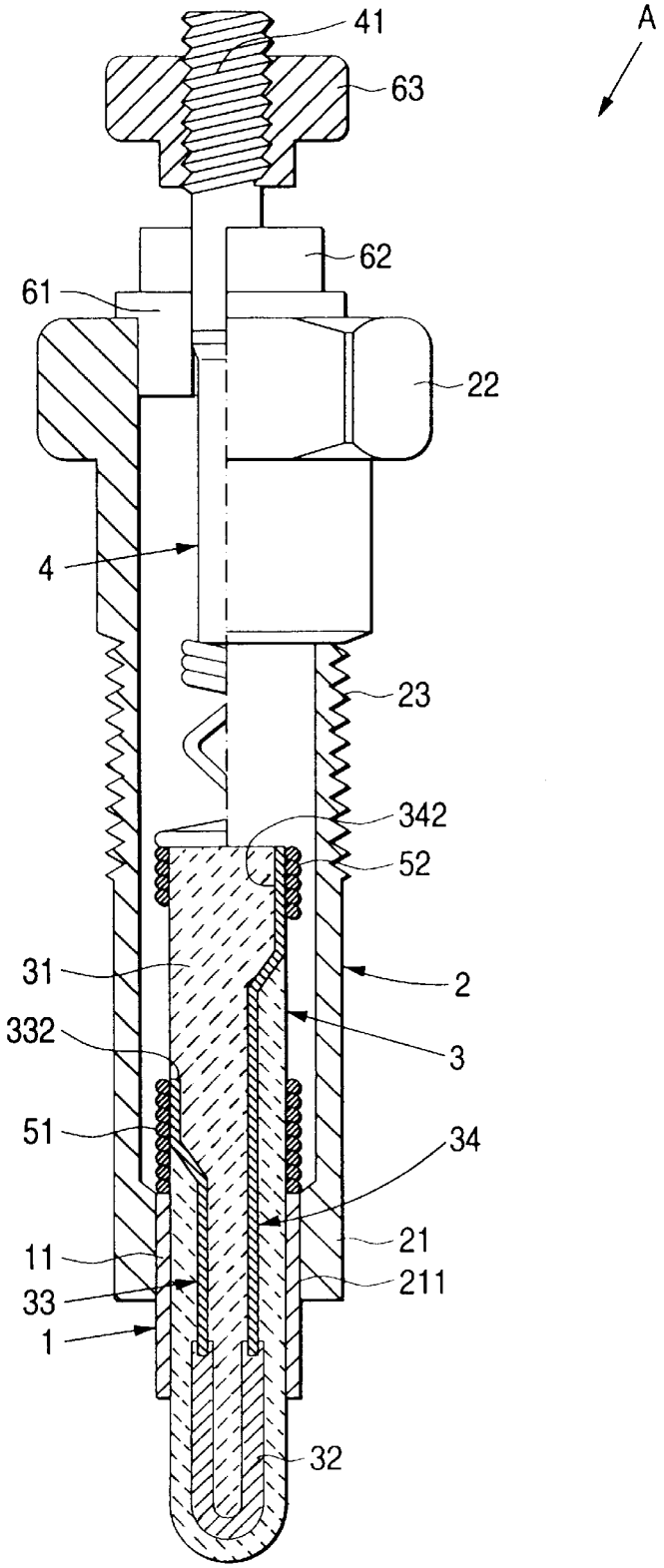
FIG. 1 is a sectional view of a glow plug according to the first embodiment of the present invention.
Figure 2:
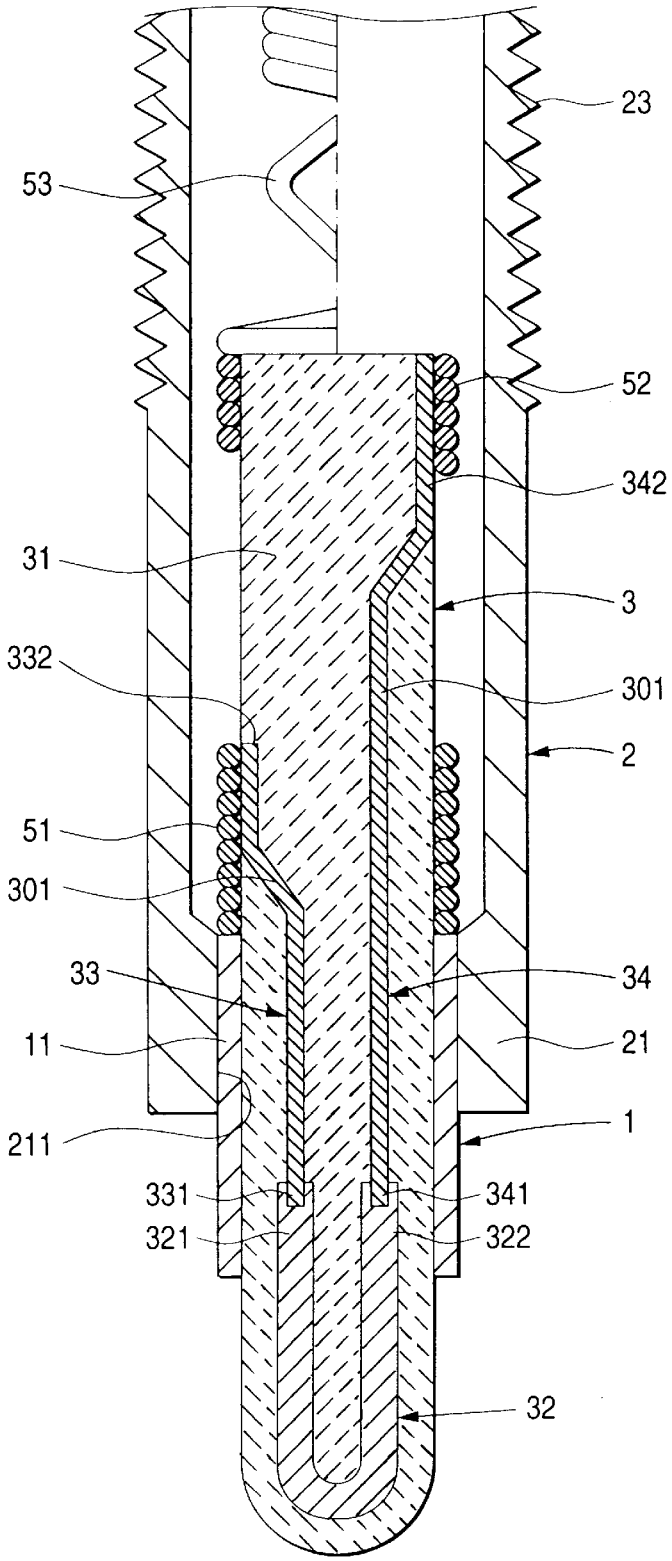
FIG. 2 is an enlarged sectional view illustrating important parts of the glow plug.
Figure 3:
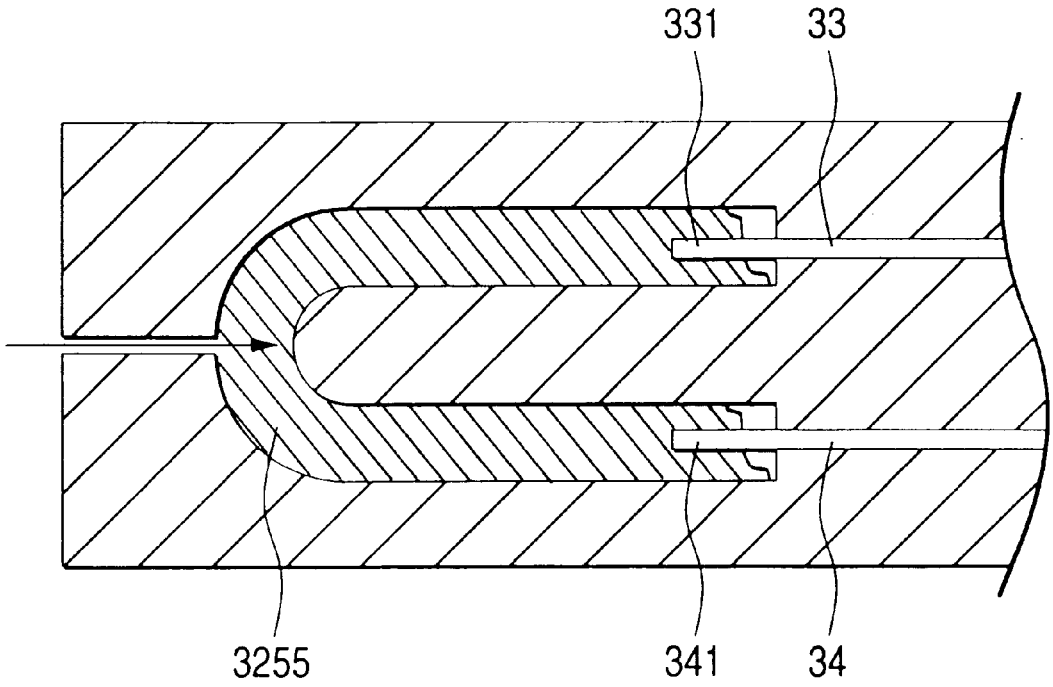
FIG. 3 is an explanation diagram showing an injection-molding of granular material.

Detailed description of the present invention will be described as follows referring to the accompanying drawings.

An embodiment of the present invention will be explained below by reference to FIGS. 1 to 6.

A glow plug A has a metallic sheath 1; a cylindrical main metallic shell 2 having at the front end thereof a holding part 21 for holding a rear part 11 of the metallic sheath 1; a ceramic heating element 3 fitted into the metallic sheath 1; and a terminal electrode 4 inserted into the cylindrical main metallic shell 2 with being insulated therefrom.

The metallic sheath 1 having a thickness of 0.6 mm is made of a heat-resistant metal, and the rear part 11 thereof is brazed to the inner wall 211 of the holding part 21 with silver brazing material.

The cylindrical main metallic shell 2 made of carbon steel, which has at the front end thereof the holding part 21 extending inward, further has at the rear end thereof a hexagonal part 22 for wrenching and in an intermediate part thereof a screw thread 23 for screwing the glow plug to a combustion chamber of a diesel engine.

The ceramic heating element 3 produced by the process described later, which lead-out wires 33 and 34 and a U-shaped heating resistor 32 are embedded in a ceramic 31 mainly composed of $Si_3N_4$.

Since the heating resistor 32 is embedded in the ceramic 31 so that the distance between the surface of the heating resistor 32 and that of the ceramic 31 becomes at least 0.3 mm, the heating resistor 32 can not only be prevented from oxidizing even when heated to high temperatures (800–1, 500° C.), but also retain high mechanical strength.

Figures 4, 4A:
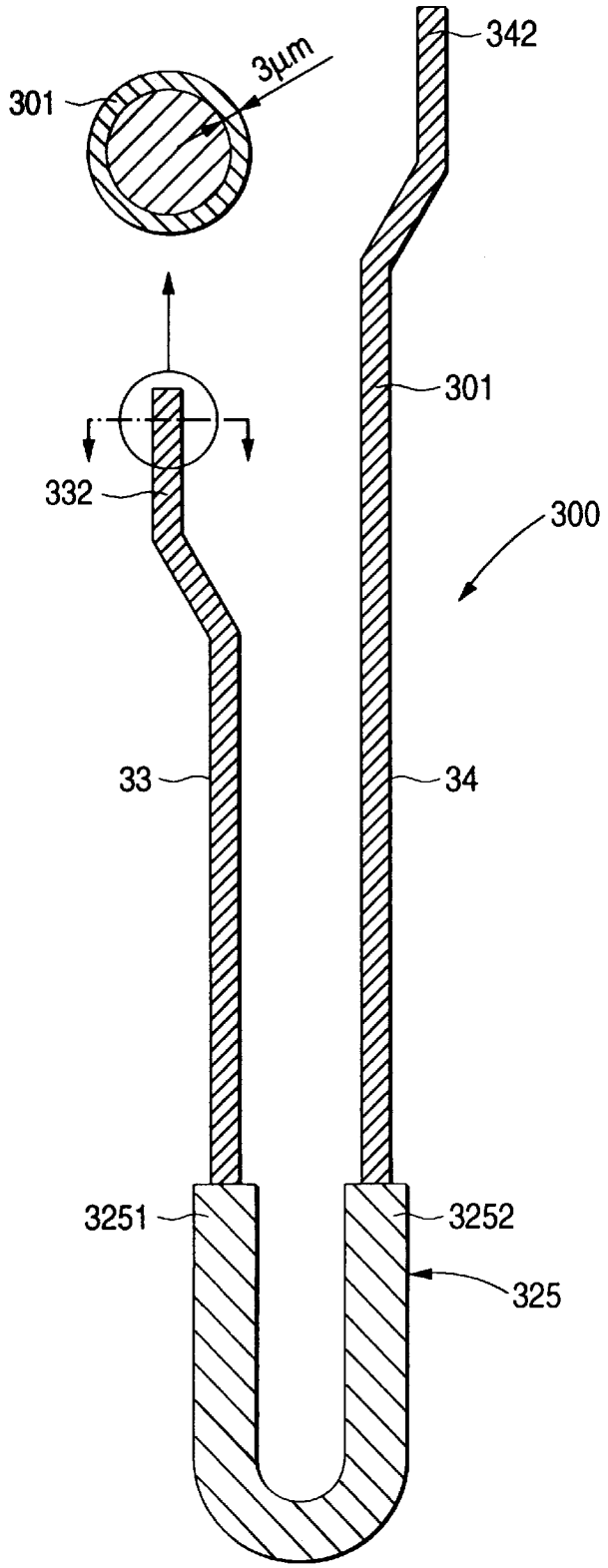
FIG. 4 is a view illustrating a heater main body completed.
FIG. 4A is a cross-section of a lead-out wire taken along the arrows in FIG. 4.

The lead-out wires 33 and 34 each consists of a tungsten wire having a diameter of from 0.3 to 0.4 mm and silver 301 deposited by electroplating having a thickness of 3 $\mu$m on the surface of the wire (see FIG. 4). One-side ends 331 and 341 thereof is connected respectively to the ends 321 and 322 of the heating resistor 32, while the other ends 332 and 342 thereof is exposed on the ceramic surface in an intermediate part and a rear part, respectively, of the ceramic 31. The thickness of the silver deposit is preferably from 1 to 10 $\mu$pm (more preferably from 3 to 8 $\mu$m) from the standpoints of the effect of diminishing the formation of an undesirable tungsten compound layer and cost.

Lead-out wires used for a comparative glow plug each consists of a tungsten wire having no coating on the surface thereof.

The other end 332 of the lead-out wire 33 is electrically connected to the cylindrical main metallic shell 2 through a spring type external connecting wire 51 and then through the metallic sheath 1.

The other end 342 of the lead-out wire 34 is electrically connected to the terminal electrode 4 through spring type external connecting wires 52 and 53.

The terminal electrode 4 having a screw thread 41 is fixed to the cylindrical main metallic shell 2 with an insulator 61 and a nut 62 so that the electrode 4 is insulated from the metallic shell 2. Numeral 63 denotes a nut for fixing an electrical supply fitting (not shown) to the terminal electrode 4.

Method for producing the ceramic heating element 3 and for producing a ceramic heating element for a comparative glow plug will be explained next.

A tungsten wire is cut into given lengths and formed into given shapes. These cut tungsten wires 33 and 34 are electroplated with silver 301 in a thickness of 3 $\mu$m.

No coating is formed on the cut tungsten wires for a comparative ceramic heating element.

First, a raw material of the heating resistor is prepared.

The raw material of the heating resistor contains 58.4 wt % of WC and 41.6 wt % of an insulating ceramic containing 89 parts by weight of $Si_3N_4$, 8 parts by weight of $Er_2O_3$, 1 part by weight of $V_2O_3$ and 2 parts by weight of $WO_3$.

A dispersion agent and a solvent are added, and the mixture is crushed and dried. Thereafter, an organic binder is added in the mixture to produce a granular material 3255.

The granular material 3255 thus obtained is injection-molded so as to be connected to one-side ends 331 and 341 of the silver-coated lead-out wires 33 and 34 (and the uncoated lead-out wires). (see, FIG. 3) Thus, a heater main body 300 consisting of a U-shaped non-sintered heating resistor 32 having the lead-out wires 33 and 34 united therewith (and a heating resistor for a comparative glow plug) is molded (see FIG. 4).

Next, ceramic powder is prepared.

A raw material of the ceramic powder contains 3.5 wt % of $MoSi_2$ and 96.5 wt % of an insulating ceramic containing 89 parts by weight of $Si_3N_4$, 8 parts by weight of $Er_2O_3$, 1 part by weight of $V_2O_3$ and 2 parts by weight of $WO_3$.

Among these components, at first, a dispersing agent and water is added to $MoSi_2$, $Er_2O_3$, $V_2O_3$ and $WO_3$, and the mixture is crushed. Then, $Si_3N_4$ is added to the mixture and crushed again. Thereafter, an organic binder is added to produce a granular material.

Figure 5A:
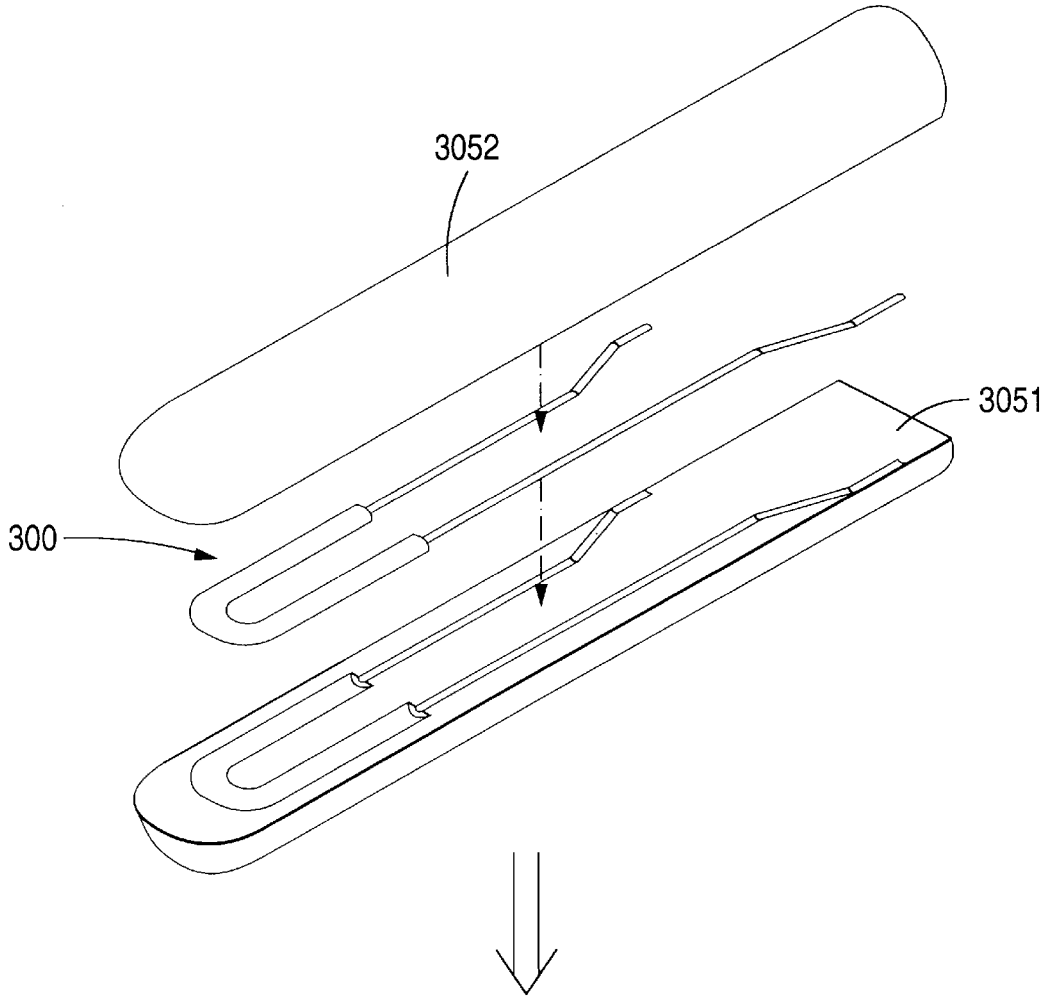
FIGS. 5A and 5B are explanation diagrams showing a molding of a press-molded body.
Figure 5B:
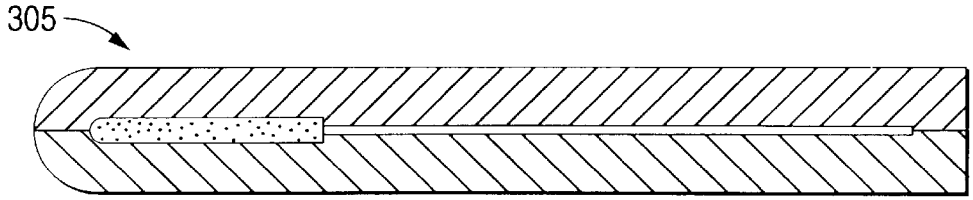

Next, a pair of half-divided pressed bodies 3051, 3052 is produced by the ceramic powder. The heater main body 300 (and the comparative heating body) is placed on the half-divided pressed body 3051, and the half-divided pressed body 3052 is placed thereon to form a press-molded body 305. (FIGS. 5A and 5B).

Figure 6A:
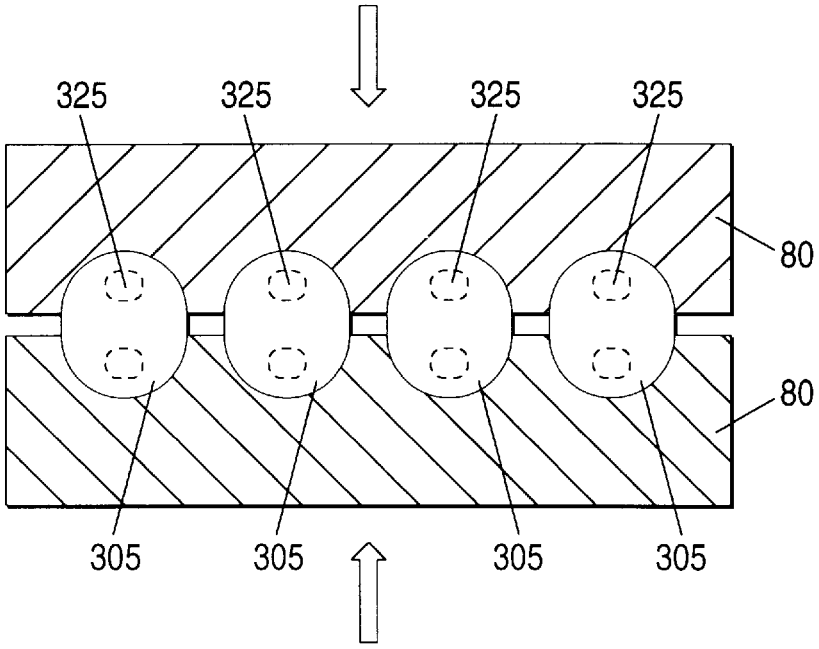
FIGS. 6A and 6B are explanation diagrams showing a hot-press molding of a ceramic sintered body.
Figure 6B:
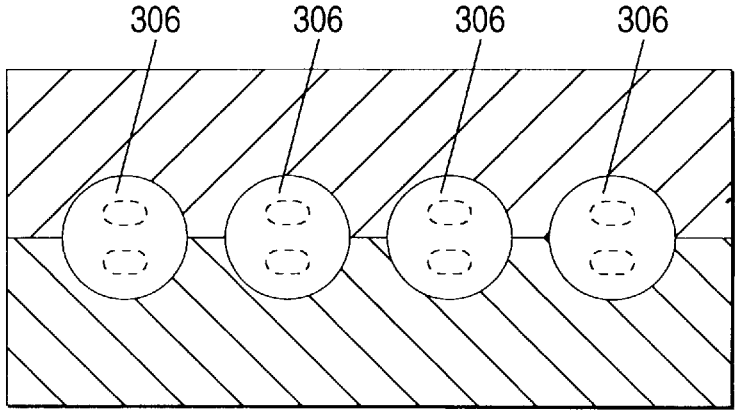

The press-molded body 305 thus obtained is set in a carbon mold 80 and hot-pressed at 1,750° C. in an $N_2$ gas atmosphere while applying a pressure of 200 kg/cm$^2$ to thereby mold a ceramic sintered body 306 in the form of a nearly round rod with a semispherical front end. (FIGS. 6A and 6B).

The outer surface of this ceramic sintered body 306 is ground to finish the sintered body so as to have a given cylindrical dimension and, at the same time, to expose the other ends 332 and 342 of the lead-out wires 33 and 34 on the surface of the ceramic 31. Thus, a ceramic heating element 3 (and a ceramic heating element for a comparative glow plug) is completed.

A glass layer is formed through baking on the ceramic heating element 3 (and the comparative heating element) in its area where the element 3 is held by a metallic sheath 1 and in its peripheral areas where the element 3 is connected to external connecting wires 51 and 52 (excluding the exposed areas of the lead-out wires 33 and 34).

The ceramic heating element 3 is electrically connected to the metallic sheath 1 and to the external connecting wires 51 and 52 by brazing. The external connecting wire 51 is likewise electrically connected to the rear end of the metallic sheath 1.

This assembly of the ceramic heating element 3 is inserted into a cylindrical main metallic shell 2. A rear part 11 of the metallic sheath 1 is brazed with silver brazing material to the inner wall 211 of a holding part 21 of the main metallic shell 2.

Furthermore, a terminal electrode 4 is fixed to the main metallic shell 2 with an insulator 61 and a nut 62. Thus, a glow plug A (and a comparative glow plug) is completed.

Ten samples of the glow plug A according to the present invention, containing lead-out tungsten wires having a silver coating (deposited by electroplating; 3 $\mu$m) on the surfaces thereof, and ten samples of the comparative glow plug B, containing lead-out tungsten wires with no silver coating, were prepared in the above described manner. A durability test was conducted in which the samples were subjected to 10,000 cycles each consisting of 1-minute application of current (temperature of the tip of the ceramic heating element, 1,400° C.) and 1-minute suspension of current application (cooling to room temperature). The results of the durability tests are exhibited in Tables 1 and 2.

TABLE 1

| Glow Plug A of the Invention (Ag deposit, 3 $\mu$m) | | |
|---|---|---|
| Resistance before durability test (mΩ) | Resistance after durability test (mΩ) | Increase in resistance (mΩ) |
| 760 | 770 | +10 |
| 741 | 744 | +3 |
| 728 | 740 | +12 |
| 768 | 772 | +4 |
| 760 | 766 | +6 |
| 782 | 786 | +4 |
| 722 | 730 | +8 |
| 757 | 762 | +5 |
| 784 | 788 | +4 |
| 729 | 739 | +10 |

TABLE 2

| Comparative Glow Plug B (no Ag deposit) | | |
|---|---|---|
| Resistance before durability test (mΩ) | Resistance after durability test (mΩ) | Increase in resistance (mΩ) |
| 769 | 789 | +20 |
| 746 | ∞ | wire break |
| 817 | ∞ | wire break |
| 757 | 782 | +25 |
| 751 | ∞ | wire break |
| 706 | ∞ | wire break |
| 761 | ∞ | wire break |
| 777 | 803 | +26 |
| 759 | ∞ | wire break |
| 783 | 825 | +42 |

As shown in Table 2, with respect to the comparative glow plug B, six of the ten samples suffered lead-out wire break (near the surface of the ceramic heating element) during the period of from the 1,000th to the 9,000th cycle. Two of these were found cracks in the ceramic heating element. Although the remaining samples did not suffer wire break, the resistance values therefor increased by 20 to 42 mΩ through the test (resistance change ratio: +2.6% to +5.4%).

In contrast, as shown in Table 1, with respect to the glow plug A according to the present invention, none of the samples suffered lead-out wire break or cracking until the completion of the durability test. The resistance values for the ten samples which were undergone the durability test were higher than the initial resistivity values from 3 to 12 mΩ (resistance change ratio: +0.5 to +1.6%). It was thus demonstrated that the formation of a silver coating was effective in restraining the reaction of the lead-out tungsten wires to thereby attain a stable resistance value.

Incidentally, in a case of the present embodiment in which the raw material of the heat resistor contains WC, a part of WC may be changed to $W_2C$ after sintering.

Accordingly, Ag coating also can result in the reaction of tungsten lead wire with carbon which is generated when WC is changed to $W_2O$ in the ceramic heater producing process at the time of hot-press sintering.

Besides the embodiment described above, the present invention includes the following embodiments.

1) The heating resistor may be a metallic heating coil (e.g., a W—Re wire or a tungsten wire), besides nonmetallic heating elements such as that used in the above embodiment (a mixture of WC and $Si_3N_4$).

2) The lead-out wires may be wires of a tungsten alloy, e.g., a W—Si alloy or a W—Ni alloy, besides the lead-out wires used in the above embodiment (wires of pure tungsten).

3) The ceramic may be Sialon, AlN, or the like, besides $Si_3N_4$.

4) The metal coating formation on the surfaces of lead-out wires may be conducted by chemical plating, hot dipping, thermal spraying, vapor deposition, diffusion coating, application of a cladding material, etc., besides being conducted by electroplating.

5) The material of the metal coating may, for example, be gold, platinum, titanium, tantalum, or nickel, besides silver. All these materials have the same effect, and are capable of restraining the lead-out wires consisting of tungsten or a tungsten alloy from changing in resistance to thereby enable the wires to have a constant resistance value.

What is claimed is:

1. A ceramic heater produced by a process comprising the steps of:

coating an entire surface of a pair of lead-out wires, the entire surface extending from a take-out wire to a U-shaped heating resistor, with a metal;

connecting one-side ends of said pair of lead-out wires comprising tungsten to both ends of the U-shaped heating resistor to obtain a heater main body;

embedding said heater main body in a ceramic powder comprising at least one of $Si_3N_4$, Sialon, and AlN; and hot-pressing said powder containing said heater main body embedded therein to sinter said powder to thereby obtain a sinter in which the other ends of said lead-out wires are exposed on a surface of said resultant sinter.

2. A ceramic heater according to claim 1, wherein the metal coating comprises a metal selected from silver, gold, platinum, titanium, tantalum and nickel.

3. A ceramic heater according to claim 1, wherein said heating resistor is a metallic heating material comprising tungsten or a W—Re alloy, or a nonmetallic heating material comprising a mixture of a WC powder and a ceramic powder.

4. A ceramic heater according to claim 1, wherein said metal coating on said wire surfaces is formed by electroplating, chemical plating, hot dipping, thermal spraying, vapor deposition, diffusion coating or application of a cladding material.

5. A ceramic heater according to claim 1, wherein the metal coating has a thickness of from 1 to 10 $\mu$m.

6. A ceramic heater according to claim 5, wherein the metal coating has a thickness of from 3 to 8 $\mu$m.

7. A ceramic heater according to claim 1, which is adapted for use in a glow plug to be fitted to a diesel engine.

8. A method of producing a ceramic heater comprising the steps of:

connecting one-side ends of a pair of lead-out tungsten wires comprising tungsten, an entire surface of said lead-out tungsten wires being coated with a metal selected from Ag, Au, Pt, Ti and Ta, the entire surface of the lead-out tungsten wires extending from a take-out wire to a U-shaped heating resistor, to both ends of the U-shaped heating resistor to obtain a heater main body;

embedding said heater main body in a ceramic powder comprising one of $Si_3N_4$, Sialon, or AlN;

hot-pressing said powder containing the heater main body embedded therein;

sintering said powder to thereby obtain a sintered body; and exposing the other ends of the lead-out wires on a surface of the sintered body.

9. A method according to claim 8, wherein said metal coating on the wire surfaces is formed by electroplating, chemical plating, hot dipping, thermal spraying, vapor deposition, diffusion coating, or application of a cladding material.

10. A method according to claim 8, wherein the metal coating has a thickness of from 1 to 10 $\mu$m.

11. A method according to claim 10, wherein the metal coating has a thickness of from 3 to 8 $\mu$m.

* * * * *